US005626267A

United States Patent [19]

Peruski

[11] Patent Number: 5,626,267

[45] Date of Patent: May 6, 1997

[54] GARMENT SHAPING TAPE AND METHOD

[76] Inventor: Robert Peruski, 6686 Orchard Lake Rd., West Bloomfield, Mich. 48322

[21] Appl. No.: 104,667

[22] Filed: Aug. 11, 1993

[51] Int. Cl.[6] ..... D06C 15/00; A41M 43/00; A41B 3/12

[52] U.S. Cl. ..... 223/84; 223/4; 223/1; 2/137; 2/129

[58] Field of Search ..... 2/137, 260.1, 129, 2/132, 175.4, 195.5, 175.5, 195.6; 223/52, 52.1, 82, 83, 84, 2, 3, 4, 1; 428/343, 344

[56] References Cited

U.S. PATENT DOCUMENTS

| | | | |
|---|---|---|---|
| 459,942 | 9/1891 | Brown | 2/175.4 |
| 1,324,028 | 12/1919 | Blume | 2/137 |
| 2,595,133 | 4/1952 | Golden | 2/260.1 |
| 2,771,385 | 11/1956 | Humphner | 428/343 |
| 4,169,753 | 10/1979 | Wendell | 2/260.1 |
| 4,626,311 | 12/1986 | Taylor | 2/260.1 |
| 4,690,852 | 9/1987 | Hull | 428/344 |
| 4,759,981 | 7/1988 | Weil | 428/343 |

FOREIGN PATENT DOCUMENTS

| | | | |
|---|---|---|---|
| 832549 | 4/1960 | United Kingdom | 2/195.6 |

*Primary Examiner*—Bibhu Mohanty
*Attorney, Agent, or Firm*—Alex Rhodes

[57] ABSTRACT

A tape for shaping garments comprised of a thin narrow malleable metal strip, a thin narrow backing strip of a flexible material, coated on one side with a pressure-sensitive adhesive, bonded to the metal strip, and an easily removable protective strip overlying the metal strip. The metal strip is preferably formed from malleable copper, aluminum or mild steel, such that it can be easily shaped by hand. The backing strip is wider than the metal strip whereby its adhesive coated side portions extend outwardly from the edges of the metal strip for bonding the protective strip. In an alternate embodiment of the invention, the backing strip is eliminated by adhesively coating the metal strip and bonding the protective strip directly to the metal strip.

7 Claims, 2 Drawing Sheets

GARMENT SHAPING TAPE AND METHOD

BACKGROUND OF THE INVENTION

This invention relates to garment shaping devices and methods and more particularly to a garment shaping tape and method.

Clothes pressing, starch, and "wash and wear" treatment are common methods for improving garment appearance. To a limited extent, mainly for men's shirts, flexible stays are used for shaping collars. One problem with collar stays is that they are often lost. Another problem is that they are frequently left in garments and become distorted during washing.

Another aspect of the current practice is that some materials, particularly silks and rayons, cannot be treated with "wash and wear" chemicals because they would adversely affect appearance and feel. Moreover, many garments, whether new or after once being worn, require shaping.

SUMMARY OF THE INVENTION

The present invention is an adhesive tape and method for shaping collars, lapels, cuffs and the like of shirts, blouses, dresses and jackets. It is also useful for shaping other articles such as bow ties, hats and ornamental handkerchiefs which are displayed in jacket pockets.

In the first aspect of the invention, a thin narrow strip of a malleable metal in rolls or cut lengths is bonded to an adhesive coated backing strip and covered by a "peel off" protective paper strip. The protective strip is removed from the malleable strip which is adhesively bonded with the backing strip to the underside of a fabric. After bonding, the strip is formed by hand to provide the proper shape to the garment.

In the second aspect of the invention, a thin narrow strip of a coated malleable metal, in rolls or cut lengths, is adhesively coated and covered by a "peel off" strip bonded to the adhesive coating.

One benefit of the invention is that it does not require garment pockets for retention. Another benefit of the invention is that it can be formed by hand into a variety of shapes either before or after it is attached to a garment. Still yet another benefit is that it is detachable from a garment for laundering or dry cleaning.

Further features and benefits of my invention, will be apparent from the ensuing detailed description taken in conjunction with the accompanying drawings. The best mode which is contemplated in practicing my invention is disclosed and the subject matter in which exclusive property rights are claimed is set forth in each of the numbered claims which are appended to the detailed description.

DETAILED DESCRIPTION OF THE PREFERRED EMBODIMENT

Figure 2:
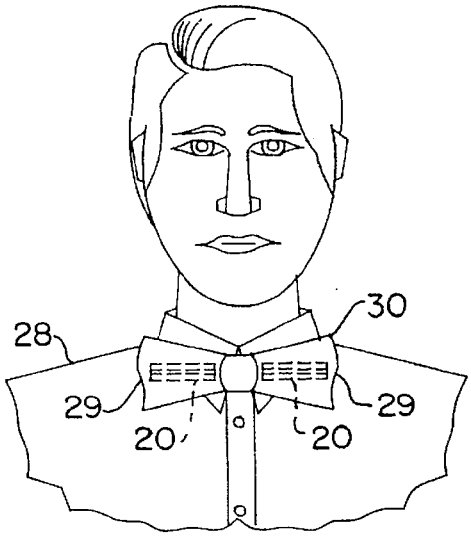
FIG. 2 is a front view of a man wearing a bow tie with a pair of garment shaping tapes, according to the invention.
Figure 3:
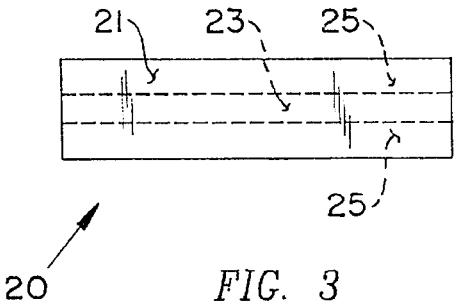
FIG. 3 is a front view of the garment shaping tape drawn to an enlarged scale.
Figure 4:
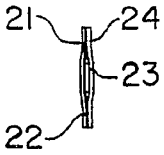
FIG. 4 is a left end view of the garment shaping tape.

Referring now to the drawings wherein like numerals designate like and corresponding parts throughout the several views, a garment shaping tape 20 is shown in FIGS. 2 through 4, according to the invention.

The garment shaping tape 20 is comprised of a thin narrow backing strip 21 of a flexible material which is coated on one side with a pressure-sensitive adhesive 22, a thin narrow malleable metal strip 23 bonded to the coated side of the backing strip 21, and a protective strip 24 overlying the metal strip 23. One requirement for the adhesive 22 is that it should not leave a residue when it is removed from an article of clothing.

Figure 5:
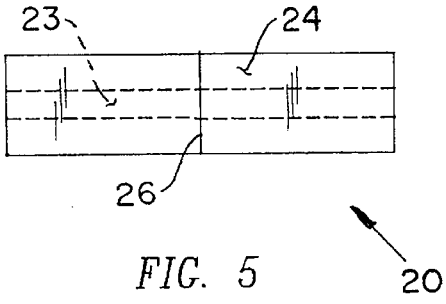
FIG. 5 is a rear view of the garment shaping tape.

The metal strip 23 is preferably formed from malleable copper, aluminum or mild steel, such that it can be easily shaped by hand. The backing strip 21 is wider than the metal strip 23 whereby adhesively coated side portions 25 extend outwardly from the side edges of the metal strip 23. With reference to FIG. 5, the protective strip 24 preferably has perforations 26 to facilitate its removal from the backing strip 21.

Paper, plastic or cloth materials in a variety of widths, by way of example one-half inch, are suitable materials for the backing strip 21. The protective strip 24 is of the same width as the backing strip 21 and is bonded to the outward extending coated side portions 25 of the backing strip 21. The protective strip 24 is made of a coated paper or other material which is easily detachable from the backing strip 21. The thickness of the metal strip 23 is sufficient to retain its shape while allowing the strip to be shaped by hand. The garment shaping tape 20 can be provided in cut lengths or in the form of a roll.

Figure 1:
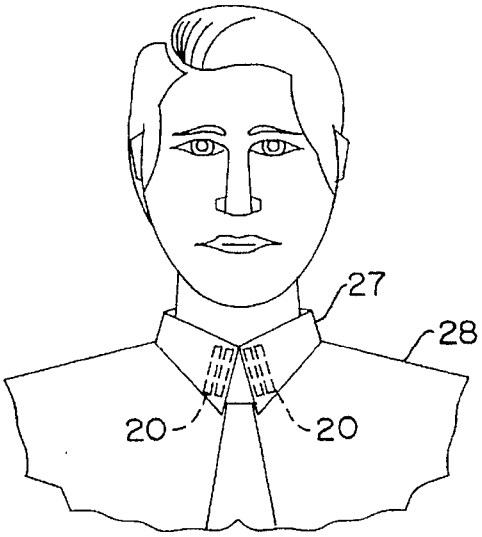
FIG. 1 is a front view of a man wearing a dress shirt with a pair of garment shaping tapes, according to the invention.

FIGS. 1 and 2 are exemplary of the applications of my invention. In FIG. 1, a pair of my garment shaping tapes 20 are applied to a collar 27 of a shirt 28 by removing the protective strip 24 and pressing the coated side of the backing strip 21 against the underside of the collar 27. In FIG. 2, a pair of my garment shaping tapes 20 are used for shaping the bows 29 of a tie 30.

In addition to the above, my invention can be used for a variety of articles, by way of example, women's dresses, blouses and jacket collars; men and women's shirt, dress, blouse and jacket cuffs and lapels; and women's hats.

Figure 6:
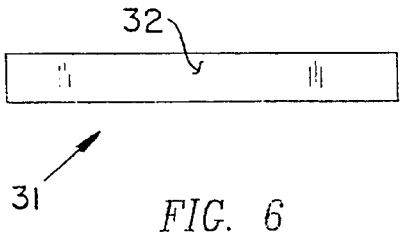
FIG. 6 is a front view drawn to an enlarged scale of a first alternate embodiment of the invention.
Figure 7:
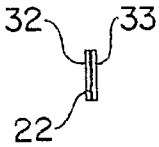
FIG. 7 is a left end view of the alternate embodiment.
Figure 8:
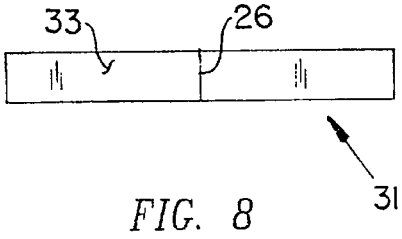
FIG. 8 is a rear view of the alternate embodiment.
Figure 9:
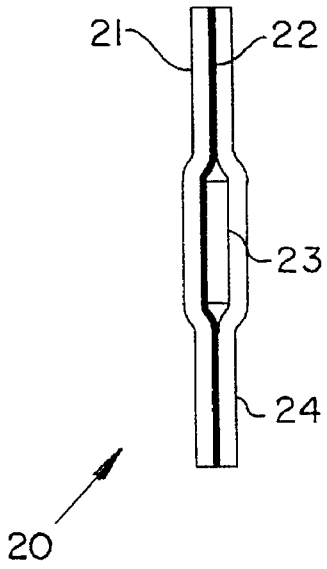
FIG. 9 is an enlarged view of FIG. 4.

In FIGS. 6–8, an embodiment 31 is shown wherein the backing strip 21 has been eliminated by coating one side of a thin narrow malleable metal strip 32 with a pressure-sensitive adhesive and bonding a thin narrow "peel off" protective strip 33 of a flexible material to the coated side of the metal strip 32. In a similar manner as the previous embodiment, perforations 26 are provided on the protective strip 33 to facilitate removal of the protective strip 33.

My invention is intended to be used in the following manner. A length of the garment shaping tape 20 is cut with a conventional pair of scissors to match a portion of a garment which is desired to be shaped. The protective strip 24 is removed from the backing strip 21 to expose the adhesive coated side portions 25 of the protective strip 24 and the tape 20 is applied to the underside of the garment. Thereafter, the tape 20 is formed by hand to the desired shape. A further use of my invention is to provide a decorative pattern on the backing strip 21 and apply tape 20 to the visible side of a garment as a fashion statement.

Figure 10:
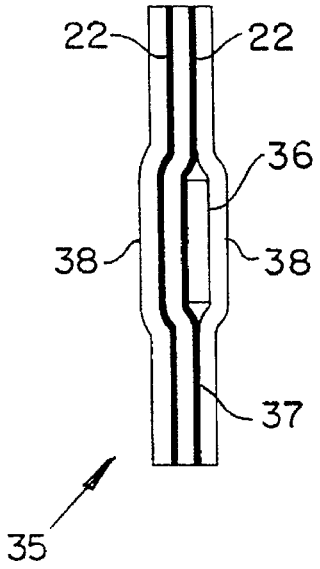
FIG. 10 is an enlarged end view of a second alternate embodiment.
Figure 12:
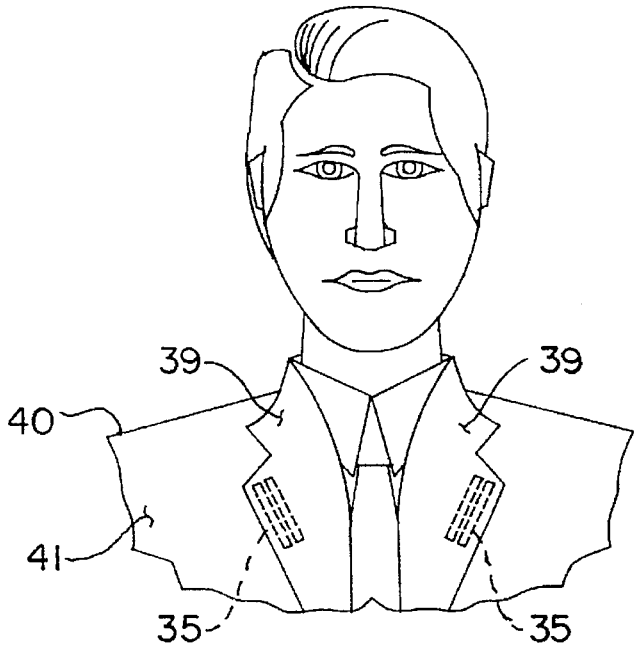
FIG. 12 is a front view of a man wearing a suit jacket with a pair of garment shaping tapes shown in FIG. 10 on the underside of the jacket's lapels.

Referring now to FIG. 10, an embodiment 35 is shown having a thin narrow malleable metal strip 36, a backing strip 37 with both sides coated with a pressure-sensitive adhesive 22, and an easily removable protective strip 38 bonded to each side of the backing strip 37. In FIG. 12, I have shown an example of the manner in which this embodiment 35 can be used. A pair of the garment shaping tapes 35, each having both of the protective strips 38 removed, is applied under the lapels 39 of a man's suit coat 40. The double coated backing strips 37 perform a dual function, first, to shape the lapels 39 and second, to adhesively retain the lapels 39 to the body 41 of the suit coat 40.

Figure 11:
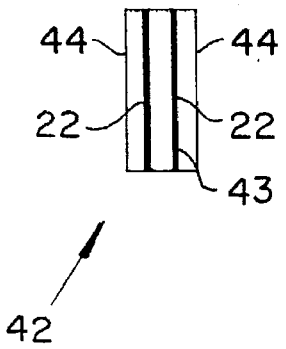
FIG. 11 is an enlarged end view of a third alternate embodiment.

In FIG. 11, an embodiment 42 is shown having a thin narrow malleable metal strip 43 with both sides coated with a pressure-sensitive adhesive 22 and an easily removable protective strip 44 bonded to each side of the metal strip 43.

From the foregoing, it will be appreciated that my invention provides a means for shaping articles of clothing which is economical, effective and easy to use. Although only several embodiments have been illustrated and described, it will be understood that other embodiments can be derived without departing from the spirit hereof.

I claim:

1. A method for selectively shaping by hand a member of a group of garments consisting of collars, lapels and bow ties, said method comprising:

a) providing a garment shaping tape which is comprised of a thin narrow malleable metal strip which is formable by hand and is pre-coated on one side with an adhesive; and an easily removable protective strip bonded to said pre-coated side of said metal strip;

b) removing said protective strip to expose said adhesive;

c) attaching said metal strip with said pre-coated adhesive to an underside of one of said members of said group of garments; and d) forming said metal strip by hand to selectively shape said garment.

2. The method as recited in claim 1 wherein said member of said group which is shaped by hand is a collar.

3. The method as recited in claim 1 wherein said member of said group which is shaped by hand is a lapel.

4. The method as recited in claim 1 wherein said member of said group which is shaped by hand is a bow tie.

5. A method for selectively shaping by hand a member of a group of garments consisting of collars, lapels and bow ties, said method comprising:

a) providing a garment shaping tape which is comprised of a thin flexible narrow backing strip which is pre-coated on one side with an adhesive; a thin malleable metal strip having a width which is less than said backing strip and is formable by hand and is bonded to said adhesive coated side of said backing strip; and an easily removable protective strip bonded to said adhesive coated side of said backing strip;

b) removing said protective strip to expose said adhesive on said backing strip;

c) attaching said backing strip with said adhesive to an underside of one of said members of said group of garments; and d) forming said metal strip by hand to selectively shape said garment.

6. A method for selectively shaping by hand a member of a group of garments consisting of collars, lapels and bow ties, said method comprising:

a) providing a garment shaping tape which is comprised of a thin narrow malleable metal strip which is formable by hand and is pre-coated on opposite sides with an adhesive; and an easily removable protective strip bonded to each side of said metal strip, each of said protective strips having a width which is greater than said metal strip;

b) removing each of said protective strips to expose said adhesive on said opposite sides of said metal strip;

c) attaching said metal strip to opposite sides of one of said members of said group of garments; and d) forming said metal strip by hand to selectively shape said garment.

7. A method for selectively shaping by hand a member of a group of garments consisting of collars, lapels and bow ties, said method comprising:

a) providing a garment shaping tape which is comprised of a thin narrow malleable metal strip which is formable by hand; a backing strip having opposite sides pre-coated with an adhesive adjacent to one side of said metal strip; and an easily removable protective strip bonded to each of said adhesive coated sides of said backing strip, each of said protective strips having a width which is greater than said metal strip;

b) removing one said protective strips to expose said adhesive coated side of said backing strip; and c) attaching said backing strip to one of said members of said group of garments; and d) forming said metal strip by hand to selectively shape said garment.

* * * * *